US005092683A

United States Patent [19]

Wurr

[11] Patent Number: 5,092,683

[45] Date of Patent: Mar. 3, 1992

[54] HIGH-STRENGTH SYNTHETIC FIBER FABRIC AND ITEMS MADE FROM SUCH FABRIC

[75] Inventor: Egon Wurr, Rheine, Fed. Rep. of Germany

[73] Assignee: Eurea Verpackungs GmbH & Co. KG, Rheine, Fed. Rep. of Germany

[21] Appl. No.: 509,995

[22] Filed: Apr. 16, 1990

[30] Foreign Application Priority Data

Aug. 19, 1989 [DE] Fed. Rep. of Germany ... 8909967[U]
Nov. 18, 1989 [DE] Fed. Rep. of Germany ..... 3938414

[51] Int. Cl.[5] ..... B65D 33/14

[52] U.S. Cl. ..... 383/24; 383/117; 428/244; 428/257

[58] Field of Search ..... 428/244, 257; 383/24, 383/117

[56] References Cited

U.S. PATENT DOCUMENTS 2,377,656 6/1945 Thomas ..... 428/257
4,232,082 11/1980 Noritake ..... 428/257
4,296,855 10/1981 Blalock ..... 428/244
4,325,469 4/1982 Gurian ..... 428/257

FOREIGN PATENT DOCUMENTS 2101559 1/1983 United Kingdom .

*Primary Examiner*—James J. Bell
*Attorney, Agent, or Firm*—Sprung Horn Kramer & Woods

[57] ABSTRACT

The invention relates to a high-strength synthetic fiber fabric which contains electrically conductive threads in addition to electrically nonconducting threads. The electrically conductive threads contain electrically conductive carbon dispersed in them. The electrically conductive threads consist of a polyolefin and are incorporated both in the warp and in the filling of the fabric. The invention also relates to a bulk container and a strap which have been made from the synthetic fiber fabric according to the invention. The fabric and the objects manufactured therefrom have excellent mechanical strength and a reliable dissipation of static electricity.

17 Claims, 2 Drawing Sheets

HIGH-STRENGTH SYNTHETIC FIBER FABRIC AND ITEMS MADE FROM SUCH FABRIC

BACKGROUND OF THE INVENTION

The present invention relates to a high-strength fabric of synthetic fibers or synthetic threads which have both electrically nonconductive threads and electrically conductive threads. The electrically conductive threads preferably contain electrically conductive carbon dispersed in them. The invention relates also to bulk material containers and carrying straps made from this synthetic fiber fabric.

Fabrics of natural or synthetic fibers or threads often tend to take on an electrostatic charge, especially when they are subjected to rubbing at low atmospheric humidity. The tendency to accumulate an electrostatic charge is particularly pronounced in fabrics of hydrophobic fibers; that is, fibers of complete synthetic polymers such as polyamides, polyesters, polyacrylates, polyacrylonitriles and polyolefins.

Electrostatic charges are a nuisance especially on clothing and carpets, since sometimes such charges become so great that a person coming in contact with a grounded object receives a strong electric shock. Moreover, electrostatic charges can be worse than a nuisance when in the vicinity of sensitive electronic circuits. Finally, the electrostatic charges can be very dangerous when such fabrics are used near explosive materials and/or in an environment where there is a risk of explosion.

Bulk containers, made from synthetic fiber fabrics, are used for a great variety of bulk goods. However, an achieved internal resistance in the fabric of the container of no more than $10^4$ ohms is still insufficient to overcome the danger of explosion resulting from static charging in the filling or emptying of the containers. In mining, for example, to prevent initiating an explosion due to static electricity produced in the filling or emptying of bulk containers in an area where there is danger of explosion due to gas or vapors, bulk containers have heretofore been used which are made from a fabric incorporating metal threads that dissipate the static charge.

A disadvantage of this solution is that these metal threads are often incorporated into the fabric as warp threads alone, so that their dissipative ability is limited. In addition, the elongation characteristic of the metal fibers or threads differs greatly from that of the rest of the fabric. This often leads to breakage of the metal threads and hence to an interruption of their ability to dissipate static charges. Due to such interruptions, the danger of sparking and explosion are greatly increased if static electric charging takes place.

It is also known to use synthetic fiber fabrics which have been rendered conductive, or not electrically chargeable, by a special chemical sizing to carry off static electricity. It has been found, however, that this antistatic sizing cannot be lastingly applied to the fabric.

The German patent publication DE-B 1,928,330 discloses fabrics which, to prevent electrostatic charging, consist of two different fiber materials. One of these materials contains electrically conductive carbon black dispersed through the entire fiber, while the other is free of carbon black. A disadvantage of this fabric is that, because it contains threads in which the carbon black is dispersed through the entire fiber, if the carbon black is contained in the fiber in an amount sufficient to achieve enough electrical conductivity the strength and stretchability of the fabric are reduced. It is to be noted that sufficient electrical conductivity cannot be achieved if the amount of carbon black contained in the fiber is too small.

SUMMARY OF THE INVENTION

A principal object of the present invention is to provide a synthetic fiber fabric in which threads of conductive material incorporated into the nonconductive synthetic fiber fabric are largely similar in their elongation characteristics to the conventional synthetic fabric and in which a lasting removal of the static electricity assured.

In contrast to the statements made in the aforementioned DE-B-1,928,330, it has surprisingly been discovered that the above stated object can be achieved in a high-strength fabric of the kind described above if the electrically conductive threads (1) consist of a polyolefin, (2) contain dispersed carbon black and/or graphite, and are (3) woven into both the warp and filling of the fabric. The fabric according to the invention has extraordinary mechanical strength and lastingly performs a reliable dissipation of static electricity.

It is advantageous if the modulus of elasticity $\epsilon$ of the electrically conductive threads is made lower than that of the rest of the thread material woven into warp and filling. This prevents the electrically conductive filaments from breaking if the fabric is subjected to great mechanical stress.

The conductive threads advantageously consist of polypropylene. The general characteristics and especially the elongation of this material are largely the same as those of synthetic threads used for the manufacture of high-strength fabrics. The conductive threads are woven into the base fabric both in the warp and in the filling. Due to the weaving in the direction of the warp and filling and to the crossing of the warp and filling threads, the base fabric is shot through with a right-angle lattice of electrically conductive threads. If they are appropriately grounded, these threade provide a lasting dissipation of the static electricity formed when the fabric is in use. Due to the weaving of the electrically conductive threads into the fabric a dissipating resistance of $10^7$ to $10^9$ ohms is achieved (in a measuring arrangement according to DIN—German Industrial Standard—No. 53 482).

The values given above can be varied. Even lower values may be achieved. For this purpose it is necessary that about every tenth to eightieth thread in both the warp and the filling of the synthetic fabric be an electrically conductive thread. The distances between the individual threads within the lattice can be varied according to requirements, but they are preferably less than 10 centimeters, and in certain applications preferably less than 2 centimeters. In addition to a lattice of approximately $9\times9$ centimeters, a lattice of 4.5–5 and 4.5–5 cm is a specialty, since the measuring electrode commonly used according to DIN 53 482 will always come in contact with one of the threads of the lattice.

The electrically conductive threads are preferably monofilaments, but fibers, threads or multifilaments of a conductive polypropylene can be used. Preferred is the use of electrically conductive threads with a titer of 1000 to 1500 dtex.

The fabric according to the invention is suitable for all applications in which high mechanical strength and reliable dissipation of static electricity are important. It can be used to advantage, for example, in mining, or also in other fields in which the danger of dust explosions, for example, exists.

The invention also concerns a bulk materials container a so-called flexible, intermediate bulk container (FIBC)—which consists of a flexible carrier bag with handles fastened thereto (carrier loops, eyelets, straps or the like), and in which the carrier has been made of a high-strength synthetic fiber fabric of the type according to the invention.

In certain parts of the carrier, such as the top and the neck area, and in the area of the filling and dumping spouts, provision is made for a constriction of the lattice of electrically conductive threads to increase the number of intersections of the warp and filling threads. Likewise, when carrying loops or the like are used, they are advantageously made at least in part of conductive material.

In an additional embodiment, the sack part of the bulk container is provided with an inner bag. The latter, like the other materials of the bulk container, is made of a fabric which, by the incorporation of electrically conductive threads in the warp and filling, achieves a dissipation resistance of about $10^7$ ohms and therefore is able to dissipate electrical charges through an appropriate ground and render them harmless.

Since a coated bulk container is required in many applications and can also be provided with a special seal at the seams, it also is possible to provide the conductive body fabric with a conductive coating of polypropylene or polyethylene; i.e., to provide such a coating not just for the top, the filling spout and/or the dump spout.

In addition to making the bulk container of conductive fabric inside and out with an appropriate coating, an additional bag liner of polyethylene is also desirable. It is then made from a conductive polyethylene into which carbon black or graphite is dispersed.

An additional improvement of the conductivity and thus of safety can be achieved by also making conductive the bonding material, such as sewing thread or the like, which joins together the individual parts of the bulk container.

Special designs or bulk containers call for a moisture barrier for the inner bag. This inner bag is at present made preferably of an aluminum sandwich film. Otherwise the liner bag can be made in accordance with the invention from an aluminum laminate film, thus also providing a conductive surface on the inside and/or outside. Such a film can also be used as a so-called "between-bag". In a between-bag design, the outer bag is made of dissipative synthetic fabric and the inner bag of conductive polyethylene. Between these outer and inner bags is an aluminum laminate which forms a moisture barrier. For other applications other intermediate materials can be used, such as corrugated cardboard or wood. The invention also relates to strapping for fastening loads to carrying devices. Such material is made of a high-strength synthetic thread fabric in accordance with the invention.

Strapping is used instead of chains, for example, for lifting loads without scarring them--loads such as metal or plastic pipes.

Strapping is used for fastening to bags, bulk carriers and the like, and can be fastened by welding, cementing or stitching.

The preferred embodiments of the present invention will now be described with the aid of the accompanying drawings.

DESCRIPTION OF THE PREFERRED EMBODIMENTS

Figure 1:
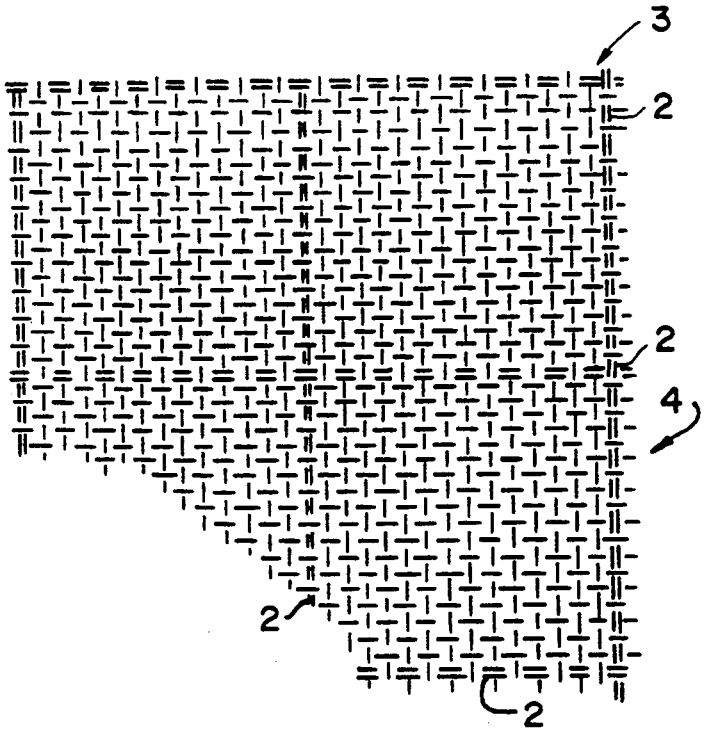
FIG. 1 shows the structure of the weave of the fabric according to the invention.

In FIG. 1 a synthetic fiber fabric is represented diagrammatically, into which electrically conductive threads 2 of preferably polypropylene are woven at intervals of 10 cm or less. By the use of the electrically conductive threads in the warp pattern 3 and in the filling 4 it is achieved that the synthetic fiber fabric is filled with a lattice network of electrically conductive threads. In this manner the fabric acquires an excellent ability to dissipate static electricity.

Figure 2:
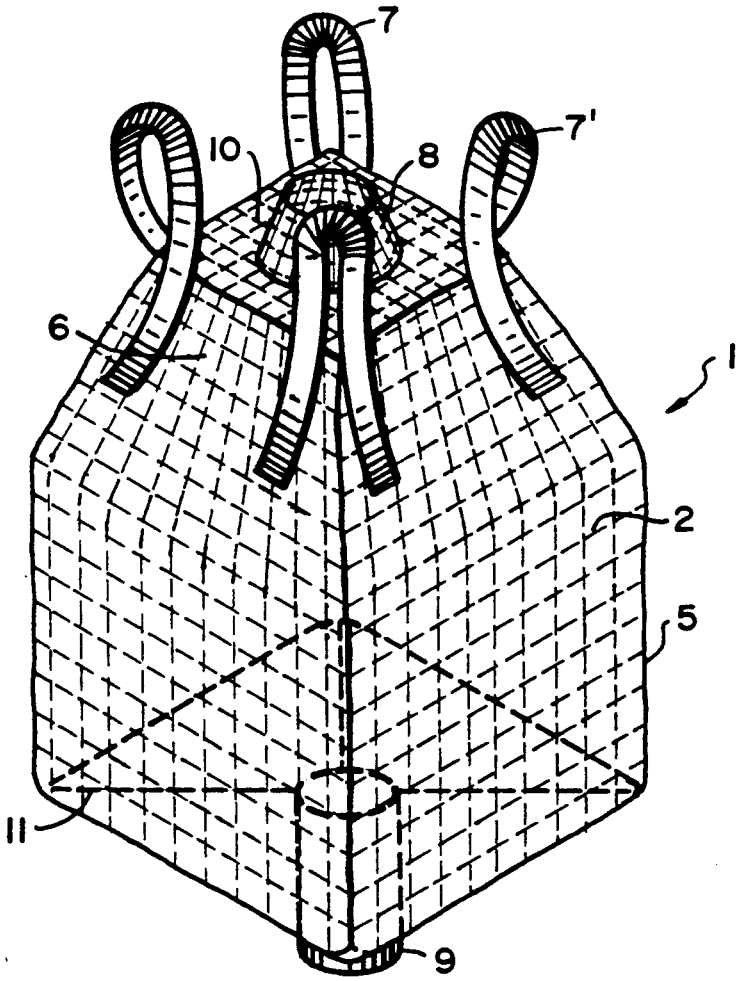
FIG. 2 is a perspective representation of a bulk container according to the invention, and strapping according to the invention.

The embodiment represented in FIG. 2 is a bulk container 1 which consists of a bag 5 with strapping used to make carrier loops 7, 7'. In its top area 10 the bag has a filling spout 8, and in its bottom 11 a dumping spout 9. The bag is made from a high-strength synthetic fiber fabric in which electrically conductive threads 2 are woven into the warp and filling. These electrically conductive warp threads 3 and filling threads 4 consist of electrically weakly conductive polyolefins, preferably polypropylene. By this weaving into the warp and filling, the synthetic fiber fabric is provided with intersecting, electrically conductive threads in a lattice network, through which, if it is suitably grounded, the static electricity developed in the use of the bulk container, chiefly by filling and emptying it, can be dissipated.

In this lattice network of electrically conductive threads the distance between the individual threads is preferably less than 10 centimeters, but it can vary according to the conductivity required.

In the neck area 6, in the top area 10, and in the area of the filling spout 8 and dumping spout 9, the lattice network of electrically conductive threads can be constricted to optimize dissipation. Likewise, conductive material is incorporated into the material of the carrying loops to assure dissipation.

Gapless grounding during filling and dumping is important to safety, so that any possible static charges will be dissipated.

In contrast to the embodiment described above, it is also possible to coat the body weave or fabric of a liner bag that may be present. Since in general a coating is not particularly conductive, the conductivity of the fabric behind it is especially important.

Another embodiment consists in coating the body weave with a conductive film which also has a surface-area resistance or dissipative resistance of $10^7$ and $10^8$ ohms. The thickness of the coating in this case is unimportant.

Figure 3:
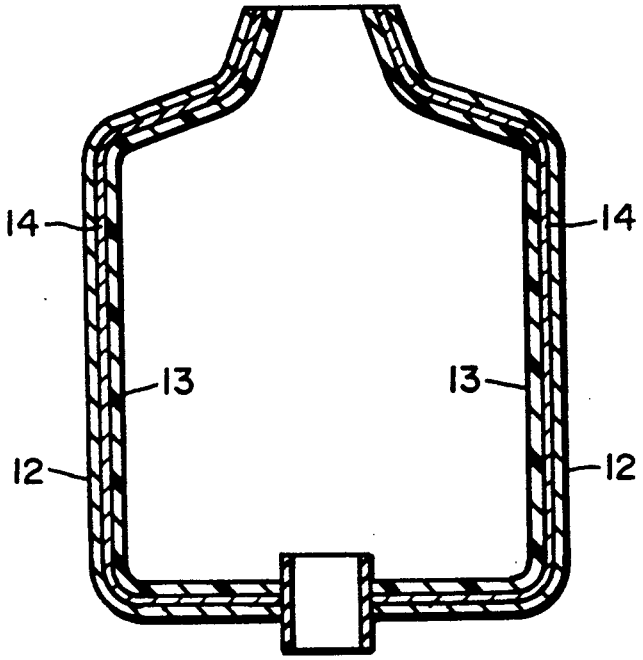
FIG. 3 is a cross sectional view of a bulk container comprising an inside bag, an intermediate bage and an outside bag.

In another embodiment, the FIBC container made of the above-described body weave is made with an inner bag of film, which achieves similar good surface-area resistance values and a dissipative resistance of $10^7$ and $10^8$. FIG. 3 shows the further possibility of using a laminated bag in which the outside bag 12 consists of conductive fabric and the inside bag 13 of conductive or not electrically chargeable polyethylene. It is also possible to make the outside bag of conductive fabric with an inner and/or outer dissipative coating. Lastly, it is also possible to build in a dissipative intermediate bag 14 made, for example, of aluminum foil, between the outside and inside bags.

The above-described inside bag of film can be a normal tube, but also by special fabrication it can be given the shape of the outer container with incorporated filling and dumping spouts if desired. In use, the inside and outside bags must be grounded when filling and dumping.

Figure 4:
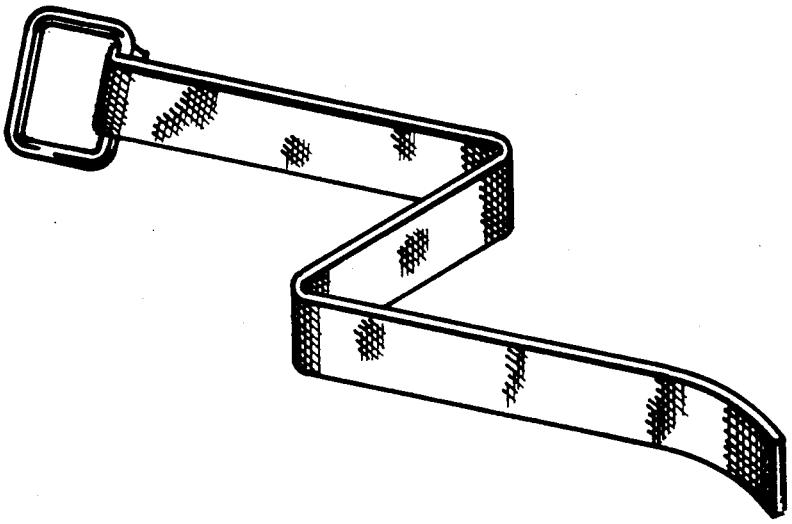
FIG. 4 is a perspective representation of a carrying strap.

The strapping (7, 7') consists of the synthetic thread fabric according to the invention. Such strapping can, also be made individually or of a different shape, in order, for example, to be slung around pipes or other objects when they have to be lifted. Such strapping is illustrated in FIG. 4. There has thus been shown and described a novel high-strength synthetic fiber fabric and items made from such fabric which fulfill all the objects and advantages sought therefor. Many changes, modifications, variations and other uses and applications of the subject invention will, however, become apparent to those skilled in the art after considering this specification and the accompanying drawings which disclose preferred embodiments thereof. All such changes, modifications, variations and other uses and applications which do not depart from the spirit and scope of the invention are deemed to be covered by the invention which is limited only by the claims which follow.

What is claimed is:

1. A bulk container comprising of a flexible carrying bag and carrying means fastened thereto, wherein the carrying bag is constructed of a electrically conductive fabric made of threads formed from synthetic fibers, said fabric having a warp and a filling and containing both electrically conductive threads and electrically nonconductive threads, wherein said electrically conductive threads comprise a polyolefin, and have dispersed in them at least one substance from the group consisting of carbon black and graphite, and wherein said electrically conductive threads are incorporated both in said warp and in said filling.

2. The bulk container defined in claim 1, where in the elasticity modulus of said electrically conductive threads is lower than that of the rest of the thread material woven into said warp and said filling.

3. The bulk container defined in to claim 1, wherein said conductive threads comprise polypropylene as a base substance.

4. The bulk container defined in claim 1, wherein every tenth to eightieth warp thread or filling thread is electrically conductive.

5. The bulk container defined in claim 1, wherein the distance of said electrically conductive threads from one another in the direction of the said warp and of said filling is not greater than 10 cm.

6. The bulk container defined in claim 1, wherein the distance of said electrically conductive threads from one another in the direction of said and of said filling is not greater than 2 cm.

7. The bulk container defined in claim 1, wherein the electrically conductive threads are monofilaments.

8. The bulk container defined in claim 1, wherein the electrically conductive threads have a titer of 1000–1500 dtex.

9. The bulk container defined in claim 1, wherein the fabric has a dissipative resistance of $10^7$ to $10^9$ ohms.

10. The bulk container defined in claim 1, having top and neck portions made of said high strength fabric, said portions having a greater number of electrically conductive filaments than in the rest of the fabric.

11. The bulk container defined in claim 1, comprising carrying loops which are made at least partially of conductive fabric or conductive threads.

12. The bulk container defined in claim 1, comprising a filling spout and a dumping spout, wherein said spouts are electrically conductive.

13. The bulk container defined in claim 1, comprising an inside bag and an outside bag, wherein at least one of the inside and outside bags consist of conductive fabric.

14. The bulk container defined in claim 13, wherein said outside bag is made from conductive fabric and said inside bag is made from conductive or not electrically chargeable polyethylene.

15. The bulk container defined in claim 13, wherein the outside bag is made from conductive fabric and has a dissipative coating inside and outside.

16. The bulk container defined to claim 13, wherein an intermediate bag is disposed between said inside bag and said outside bag.

17. The bulk container defined in claim 16, wherein said intermediate bag is made of aluminum foil.

* * * * *